United States Patent [19]

Scholer

[11] Patent Number: 4,922,475

[45] Date of Patent: May 1, 1990

[54] ALARM CLOCK HAVING MEANS FOR BRIDGING TWO CIRCULAR CONDUCTING PATHS VIA AN ADJUSTABLE CONTACT MEANS THEREBY CAUSING GENERATION OF AN ACOUSTIC ALARM SYSTEM

[76] Inventor: Matthias Scholer, Lengacker 119b, 4938 Rohrbach b. Huttwil, Switzerland

[21] Appl. No.: 162,327

[22] PCT Filed: Jun. 17, 1987

[86] PCT No.: PCT/CH87/00069

§ 371 Date: Feb. 16, 1988

§ 102(e) Date: Feb. 16, 1988

[87] PCT Pub. No.: WO87/07966

PCT Pub. Date: Dec. 30, 1987

[30] Foreign Application Priority Data

Jun. 18, 1986 [CH] Switzerland ..... 2464/86

[51] Int. Cl.[5] ..... G04C 21/16; G04C 23/16

[52] U.S. Cl. ..... 368/252; 368/262

[58] Field of Search ..... 368/252, 250, 254, 269

[56] References Cited

U.S. PATENT DOCUMENTS 4,351,043 9/1982 Ogihara et al. ..... 368/252

4,396,297 8/1983 Akahane ..... 368/262

*Primary Examiner*—Bernard Roskoski

*Attorney, Agent, or Firm*—Pearne, Gordon, McCoy & Granger

[57] ABSTRACT

Through an opening (2) in a dial (1), the hub (3) of a follower disc (4) extends. Placed on the end of the hub (3) is an alarm-setting hand (6) for reading the alarm time. The hub (3) is traversed by an hour-wheel pipe (7) which has two flattened side surfaces (23) for rotation-tight connection to a sliding wheel (12). A printed circuit board (14) is disposed adjacent to the hour-wheel (8) and has an opening (15) through which the hour-wheel pipe (7) extends. Two circular conductor paths (17, 18) disposed concentrically with the hour-wheel pipe (7) are applied to the printed circuit board (14). Between the sliding wheel (12) and the printed circuit board (14), an alarm-setting wheel (13) is rotatably disposed. The sliding wheel (12) has a recess (24) in which a contact bridge (26) is disposed. The alarm-setting wheel (13) has an aperture (38) disposed above the said conductor paths (17, 18), recesses (35) into each of which a lug (5) of the follower disc (4) projects, and an outer toothing (34) engaged by a pinion (36) for setting the alarm time. At the alarm time set, the free ends of the contact bridge (26) reach the conductor paths (17, 18) through the aperture (38) in order to connect these paths electrically to one another for triggering an alarm signal. This makes it possible to use a simple embodiment of a contact bridge which can be inserted in the alarm clock fully automatically, no subsequent adjustment being necessary.

10 Claims, 5 Drawing Sheets

ALARM CLOCK HAVING MEANS FOR BRIDGING TWO CIRCULAR CONDUCTING PATHS VIA AN ADJUSTABLE CONTACT MEANS THEREBY CAUSING GENERATION OF AN ACOUSTIC ALARM SYSTEM

BACKGROUND OF THE INVENTION

The invention relates to an alarm clock according to the generic clause of patent claim 1.

In CH patent specification No. 638,367 a wrist watch having settable, time-dependent signalling is described. This watch has an alarm-setting wheel which is adjustable from the outside by means of a button and mountingly disposed coaxial to the hour wheel on the hour-wheel pipe. The alarm-setting wheel is part of a circuit comprising an electronic control circuit and a battery electrically connected to the hour wheel. The circuit serves to control an alarm signal device and is closed by means of a contact spring resiliently secured to one side of the hour wheel, which contact spring meets a contact stud that passes through the electrically insulating minute-setting wheel and is electrically connected to a circular conductor path on the alarm-setting wheel. The contact spring glides over the insulating surface of the alarm-setting wheel until it touches the contact stud; in this connection there is an enormous risk of contamination of the contact surface, and contact-making is ill-defined in the beginning stage of the contact between the contact spring and the stud. Moreover, it is necessary that the contact spring be precisely adjusted at the time of assembly.

SUMMARY OF THE INVENTION

It is the task of the invention to provide an alarm clock of the type mentioned at the beginning in which contact-making for initiating the alarm signal takes place unequivocally and unproblematically, and in which the adjustment work on the contact elements is reduced to a minimum.

The alarm clock according to the nvention is characterized by the features recited in the characterizing part of patent claim 1.

Further embodiments are defined in the dependent claims.

The subject of the invention is explained in more detail below, by way of example, with reference to the drawing.

DETAILED DESCRIPTION OF THE PREFERRED EMBODIMENT

Figure 1:
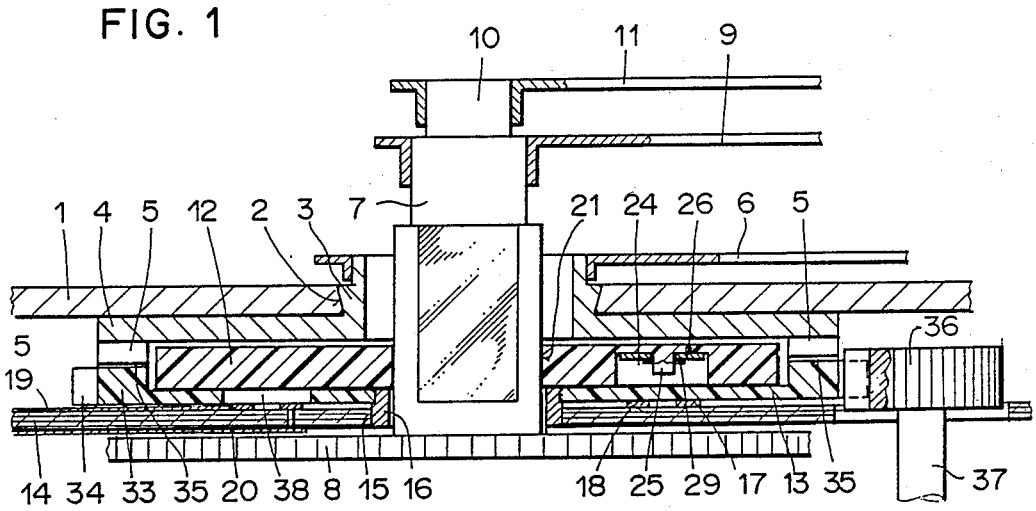
FIG. 1 shows a section along the line I—I of FIG. 2 through the central region of an exemplified embodiment of the alarm clock according to the invention.
Figure 2:
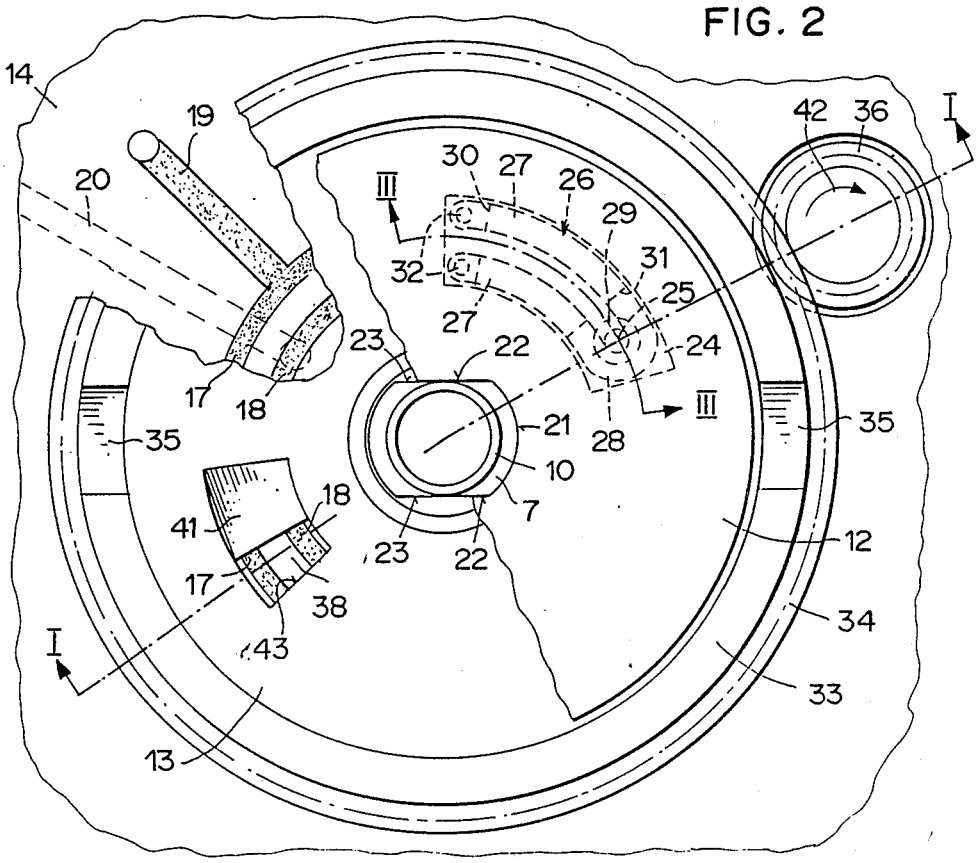
FIG. 2 shows the top plan view of the central region shown in FIG. 1, parts being omitted and other parts partially cut away.

In FIGS. 1 and 2, the central region of a first exemplified embodiment of the alarm clock according to the invention is drawn in section. A dial 1, shown only in part, has a central opening 2 through which a hollow hub 3 of a follower disc 4 extends. The follower disc 4 rests against the rear of the dial 1 and has lugs 5 extending away from the dial 1 at two opposite locations on its periphery. The follower disc 4 is rotatable relative to the dial 1, the inside wall of the said opening 2 and the circumferential surface of the hub 3 adjacent thereto being so designed that after the insertion of the hub 3 into the opening 2, there results a form-locking connection, and that a certain amount of friction must be overcome for relatively rotating the follower disc 4 with respect to the dial 1, whereby the follower disc 4 is prevented from rotating relative to the dial 1 through mere jarring. Mounted on the part of the hub 3 extending beyond the face of the dial 1 is an alarm-setting hand 6 which makes it possible to read the alarm time set.

An hour-wheel pipe 7 passes through the hub 3 and is connected rotation-tight to an hour wheel 8. On the end of the hour-wheel pipe 7 remote from the hour wheel 8, an hour hand 9 is mounted. Through the hourwheel pipe 7 there passes a cannon-pinion 10, on the other end of which a minute hand 11 is mounted. The inner end of the cannon-pinion 10 is not shown in FIG. 1.

Disposed between the follower disc 4 and the hour wheel 8 are, from outside to inside, a sliding wheel 12, an alarm-setting wheel 13, and part of a printed circuit board 14. The printed circuit board 14 has an opening 15 in which a journal-bearing bushing 16 is inserted that serves as a friction bearing for the alarm-setting wheel 13. On the side of the printed circuit board 14 facing the alarm-setting wheel 13 are two circular conductor paths 17 and 18 disposed concentrically with the bushing 16. These circular conductor paths 17 and 18 are connected via straight conductor paths 19 and 20, respectively, to components of the electronic circuit, not shown, of the alarm clock, the conductor paths 19 and 20 being situated on opposite sides of the printed circuit board 14.

A central recess 21 of the sliding wheel 12 has two straight wall portions 22 resting against flattened sides 23 of the hour-wheel pipe 7. See also FIG. 2, in which the hands 6, 9 and 11 are not shown, and the sliding wheel 12 is only partially shown, in the top plan view. The said wall portions 22 and the flattened sides 23 together provide a rotation-tight connection between the sliding wheel 12 and the hour-wheel pipe 7.

In an exemplified embodiment not shown, the hour-wheel pipe 7 may be surrounded by a pipe, not shown, on which the sliding wheel 12 is mounted in the same way as the sliding wheel 12 in the exemplified embodiment according to FIGS. 1 and 2 is mounted on the hour-wheel pipe 7. This pipe is then rotation-connected to the hour-wheel pipe 7 via a transmission in such a way that the hour-wheel pipe 7 rotates twice when the said pipe rotates only once. Such an arrangement then yields an alarm clock which wakes only every 24 hours.

On the side of the sliding wheel 12 facing the alarm-setting wheel 13 is a recess 24 running substantially parallel to the circular conductor paths 17 and 18 for a short distance. A stud 25 extends into the recess 24 from the bottom of the recess 24. Within the recess 24, a contact bridge 26, preferably of hard brass or bronze, is disposed. The contact bridge has two arcuate legs 27 connected to one another via a crosspiece 28. The crosspiece 28 rests against the stud 25, and a clamping ring 29 holds the bridge 26, with the legs 27 each having two bends 30 and 31, fast in the recess 24. On the free end of each leg 27, a contact point 32 is provided. The contact point 32 may be a boss or the head of a rivet of special contact material.

The alarm-setting wheel 13 has a rim 33 projecting axially toward the sliding wheel 12, the outer surface of which rim is provided with an outer toothing 34. In the rim 33, at two opposite locations, there are recesses 35 in which the lugs 5 of the follower disc 4 engage. The follower disc 4 is not shown in FIG. 2. Meshing with the said outer toothing 34 is a pinion 36 connected via a shaft 37 to an alarm-setting button, not shown. The alarm-setting wheel 13 has an aperture 38 through which, in FIG. 2, the circular conductor paths 17 and 18 are visible. The alarm-setting wheel 13 is preferably made of an electrically insulating plastic.

When the free ends of the legs 27 of the contact bridge 26 with the contact points 32 rest against the circular conductor paths 17 and 18, respectively, the latter are electrically connected to one another, and the alarm signal device, not shown, is actuated for producing an acoustic alarm signal.

Figure 3:
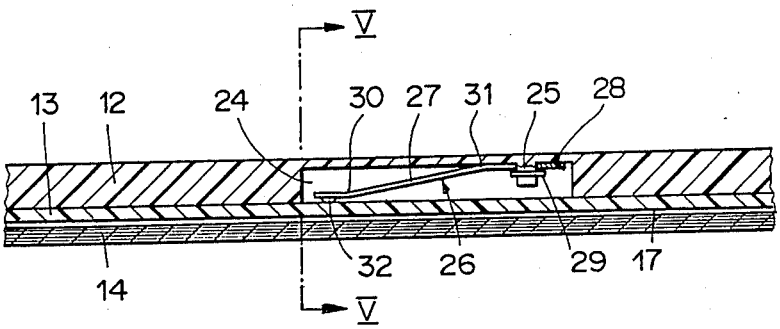
FIG. 3 shows a section along the line III—III of FIG. 2.
Figure 4:
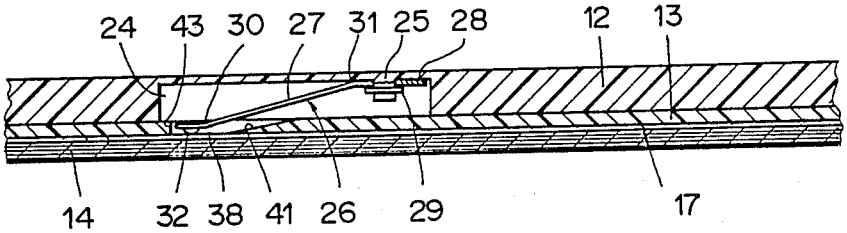
FIG. 4 shows the same kind of representation as FIG. 3 but in another position of the depicted components, in which position an alarm signal is generated.

FIG. 3 shows a section along the line III—III of FIG. 2, only a part each of the sliding wheel 12, the contact bridge 26, the alarm-setting wheel 13, the printed circuit board 14, and the conductor path 17 are visible. As stated above, the contact bridge 26 is held in the recess 24 by the clamping ring 29 in such a way that the contact points 32 at the ends of the legs 27 rest against the alarm-setting wheel 13 under a mechanical bias. When, through the relative movement between the alarm-setting wheel 13 and the sliding wheel 12, the aperture 38 arrives in the region of the free ends of the legs 27, the contact points 32 are pressed against the conductor paths 18 and 18, respectively, by the spring tension stored in the legs 27. The two circular conductor paths 17 and 18 are thereby electrically connected to one another and the generation of the acoustic alarm signal is triggered. This condition is depicted in FIG. 4.

Figure 5:
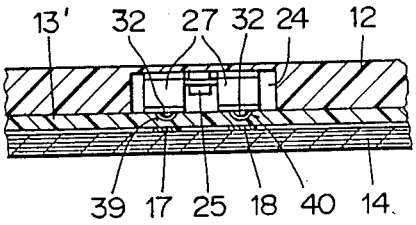
FIG. 5 shows a section along the line V—V of FIG. 3, one component being modified.

During the time during which no alarm signal is being generated, the contact points 32 of the contact bridge 26 slide along the surface of the alarm-setting wheel 13 facing this bridge. Depending upon the nature of the material of which the alarm-setting wheel 13 is made, particles of dirt may thereby accumulate at the contact points 32, whereby the contact-making may possibly no longer be ensured. In order to prevent this possible disadvantage, a design of the alarm-setting wheel 13′ as depicted in section in FIG. 5 is proposed. The alarm-setting wheel 13′ has two grooves 39 and 40 extending concentrically with the hour-wheel pipe 7, which grooves extend parallel to the circular conductor paths 17 and 18, respectively. The shape of the cross-section of the grooves 39 and 40 is similar to that of the cross-section through the contact points 32, but larger. The edge regions of the free ends of the legs 27 rest against the edges of the grooves 39 and 40 so that the contact points 32 do not come in touch with the material of which the alarm-setting wheel 13′ is made. In this way, no dirt can accumulate at the contact points, and faultless contact-making is ensured. With this embodiment of the alarm-setting wheel 13′, it is possible to dispense with the ramp 41 because the portion of the legs 27 between the bends 30 and 31, running obliquely with respect to the alarm-setting wheel 13′, assumes the function of the ramp and lifts the contact point 32 off the track 17 or 18, respectively.

The alarm-setting wheel 13 is set to the desired alarm time through rotation of the pinion 36 by means of the alarm-setting button, not shown, which time is indicated by the alarm-setting hand 6. The pinion 36 is preferably turned in the direction indicated by the arrow 42 in FIG. 2, whereby the alarm-setting wheel 13 rotates counterclockwise. If the alarm-setting wheel 13 is rotated in the opposite direction, i.e., clockwise, this means that the aperture 38 is moved from left to right, as viewed in FIG. 4, toward the contact bridge 26. At such time, the free ends of the legs 27 will strike against the vertical wall 43 of the aperture 38 and block further movement. If the alarm-setting wheel 13 is forcibly rotated farther, the danger exists that the contact bridge 26 becomes damaged if no further steps are taken to prevent this.

For protecting the bridge 26 from damage, several solutions are possible:

(a) the connection between the hour-wheel pipe 7 and the hour wheel 8 comprises a slipping clutch.

(b) by means of a pawl, not shown, the alarm-setting wheel 13 is prevented from being able to rotate clockwise, and (c) the alarm-setting button, not shown, is rotation-connected to the pinion 36 via a ratchet-wheel gearing, the rotating motion being transmitted from the alarm-setting button to the pinion 36 in only one direction.

Figure 6:
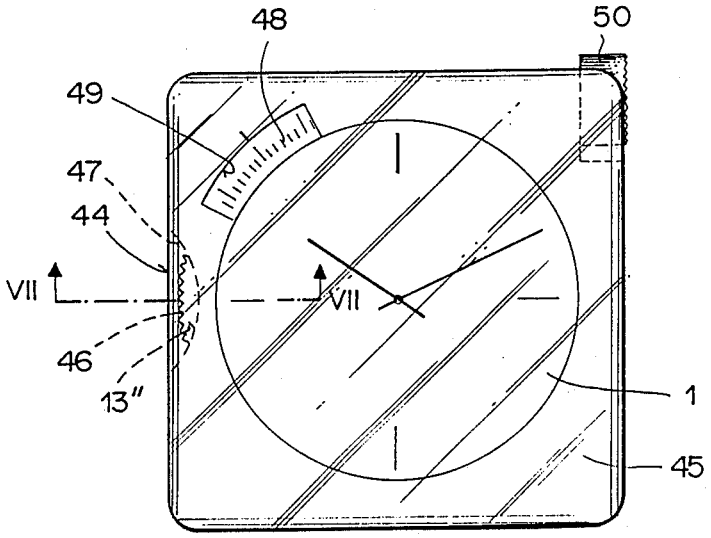
FIG. 6 shows the elevation of a second exemplified embodiment of the alarm clock according to the invention.
Figure 7:
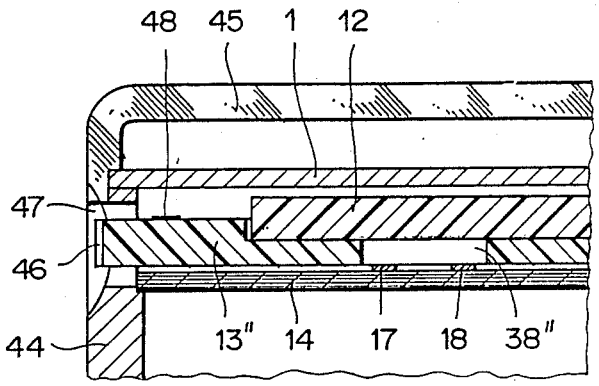
FIG. 7 shows a partial section along the line VII—VII of FIG. 6.

FIG. 6 shows a further embodiment of the alarm clock according to the invention in top plan view, and FIG. 7 is a section along the line VII—VII of FIG. 6. The dial 1 is clamped between a case 44 and a transparent cover 45. Disposed on the back of the dial 1 is the sliding wheel 12, against which a specially designed alarm-setting wheel 13″ with the aperture 38″ rests. On the side of the alarm-setting wheel 13″ facing away from the sliding wheel 12 is the printed circuit board 14 with the circular conductor paths 17 and 18. Instead of a toothing, the alarm-setting wheel 13″ has a milled edge 46 on its peripheral surface. There is a sector-shaped indentation 47 in the case 44 into which part of the peripheral region of the alarm-setting wheel 13″ projects, so that it can be rotated by means of a finger for setting the alarm time. In the edge region of the alarm-setting wheel 13″ there is a graduated scale 48 which is partially visible through an perture 49 in the dial 1 for reading the alarm time set. Because the alarm-setting wheel 13″ can be adjusted directly from outside, and the alarm time set is readable through the aperture 49, it is possible in the exemplified embodiment depicted in FIGS. 6 and 7 to dispense with the follower disc 4, the alarm-setting hand 6, and the pinion 36 of the embodiment according to FIGS. 1 and 2. In the region of the upper right-hand corner of the alarm clock depicted in FIG. 6, there is a slide 50 by means of which the generation of the alarm signal can be eliminated.

Figure 8:
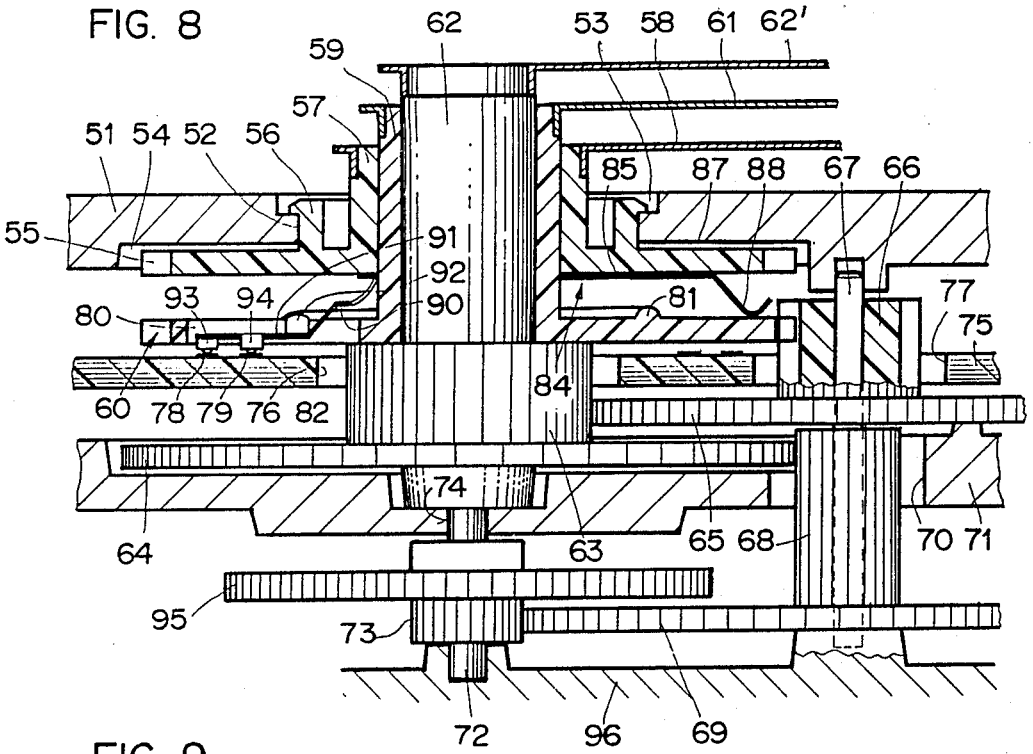
FIG. 8 shows a section through the central region of a third, preferred exemplified embodiment of the alarm clock according to the invention.

The section depicted in FIG. 8 through the central region of a third, preferred exemplified embodiment of the alarm clock according to the invention shows a portion of a dial 51 having a middle opening 52. The opening 52 has on one side a broadening 53 and on the other side a broadening 54 having a larger diameter for partially receiving an alarm-setting wheel 55. The alarm-setting wheel 55 has a hollow hub 56 which is so designed that after the insertion of the hub 56 in the opening 52, a form-locking connection results, a certain friction having to be overcome for relatively rotating the alarm-setting wheel 55 with respect to the dial 51 in order to prevent the alarm-setting wheel 55 from rotating relative to the dial 51 through mere jarring. Disposed within the hub 56 is a tubular attachment 57, part of which projects beyond the outside of the dial 51. Mounted on the projecting part of the attachment 57 is an alarm-setting hand 58 for reading the alarm time set.

Rotatably disposed within the tubular attachment 57 is an hour-wheel pipe 59, one end of which is rigidly connected to an hour wheel 60, and the other end of which bears an hour hand 61. Through the hour-wheel pipe 59 there extends a cannon-pinion 62, on the outer end of which a minute-hand 62' is mounted, and the inner end of which is rigidly connected to a pinion 63 and a center wheel 64.

The hour-wheel pipe 59 and part of the hour wheel 60 rest on the shoulder formed between the cannon-pinion 62 and the pinion 63, whereby the axial movement of the cannon-pinion 62 is limited toward the inside. The pinion 63 meshes with an intermediate wheel 65 which is rigidly connected to another pinion 66 and mounted on an arbor 67 fixed in a plate 96. The pinion 66 drives the hour wheel 60. A driving gear comprising pinion 68 and an intermediate wheel 69 is likewise mounted rotatably on the arbor 67. The pinion 68 extends through an opening 70 in a further plate 71 and meshes with the center wheel 64, while the intermediate wheel 69 engages a pinion 73 placed on a fourth-wheel arbor 72. The fourth-wheel arbor 72 extends through an opening 74 in the plate 71 and the cannon-pinion 62. A seconds hand, not shown, may be placed on the outer end of the fourth-wheel arbor 72.

The fourth-wheel arbor 72 is driven via a minute-wheel 95 by the part of the movement not shown.

Between the hour wheel 60 and the intermediate wheel 65 is part of a printed circuit board 75 having an opening 76 through which the pinion 63 rigidly connected to the cannon pinion 62 extends. Through a further opening 77 in the printed circuit board 75, the pinion 66 extends. On the side of the printed circuit board 75 facing the hour wheel 60, two circular conductor paths 78 and 79 are disposed concentric with the center-wheel arbor 62, i.e., with the pinion 63. The two circular conductor paths 78 and 79 are connected via straight conductor paths, not shown, to components of the electronic circuit, not shown, of tha alarm clock, one straight conductor path being on the other side of the printed circuit board 75 from the circular conductor paths 78 and 79.

Figure 9:
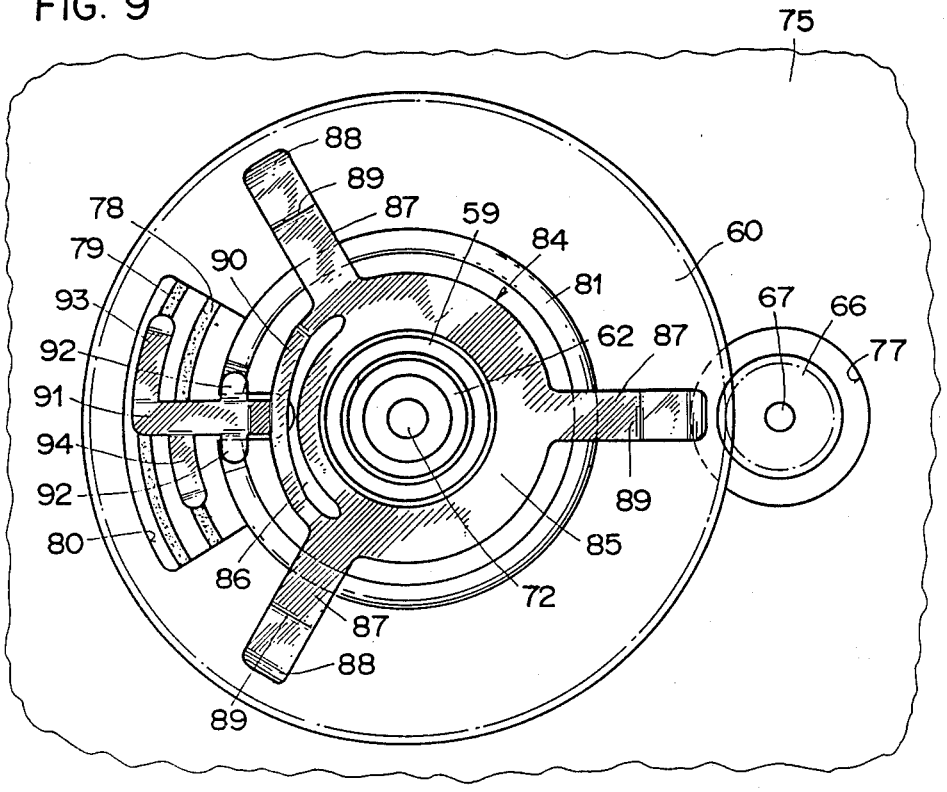
FIG. 9 shows the top plan view of part of the alarm clock according to FIG. 8.
Figure 11:
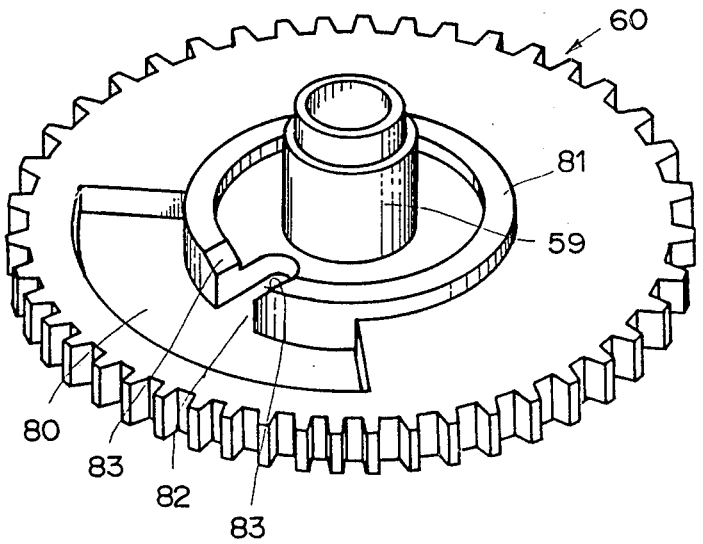
FIG. 11 shows the hour wheel of the alarm clock according to FIG. 8 in perspective view.

The hour wheel 60, preferably made of plastic, is depicted in perspective in FIG. 11 and had an arcuate aperture 80 through which part of the circular conductor paths 78 and 79 is visible in FIG. 9. Disposed concentrically around the hour-wheel pipe 59 rigidly connected to the hour wheel 60 is an axially projecting, substantially circular rib 81. From the middle region of the aperture 80, a slot 82 extends in radial direction toward the hour-wheel pipe 59. Those parts of the rib 81 which are directly at the slot 82 have beveled front surfaces 83 visible only in FIG. 11.

Figure 10:
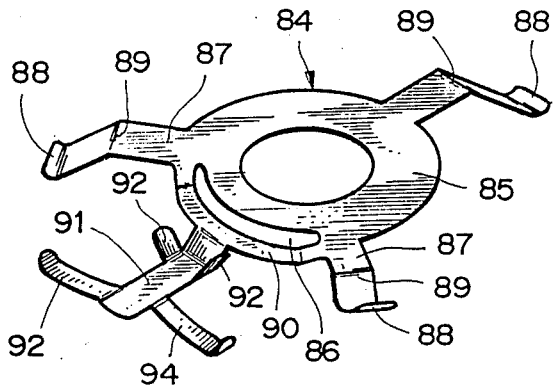
FIG. 10 shows a contact element of the alarm clock according to FIG. 8 in perspective view.

Disposed between the alarm-setting wheel 55 and the hour wheel 60 is a contact spring 84 which is depicted in perspective in FIG. 10. The contact spring 84 has a flat circular portion 85. In this portion 85 is an arcuate slot 86 extending about over an angle of 100°. From the circular portion 85, three legs 87 extend radially outward, the ends of which are curved for forming feet 88. In the middle region of each of the legs 87 there is one bending location 89 each, so that the feet 88 are not in the same plane as the circular portion 85.

The outer arch piece 90 partially bounding the slot 86 is bent over in its end regions twice each so that the middle region of the arch piece 90 lies in a different plane from the remaining circular portion 85. From the arch piece 90 there extends an arm 91 outward in radial direction. Directly at the point of connection between the arm 91 and the arch piece 90, the arm 91 is bent over twice so that the part of the arm 91 adjoining these bends extends in a further plane which is at least approximately parallel to the plane of the arch piece 90, i.e., of the circular portion 85. Disposed on the region of the arm 91 adjoining the said bends are laterally projecting tongues 92 which are bent off at an acute angle to the plane of the circular portion 85. From the outermost end of the arm 91 there extends a first wiper 93 in lateral direction, and between the first wiper 93 and the tongue 92 a second wiper 94 extends in the opposite direction from the first wiper 93. The ends of the wipers 93 and 94 are formed as electrical contacts which from time to time rest on the respective circular conductor paths 79 or 78 and electrically connect the latter to one another.

The contact spring 84, i.e., the circular portion 85 of the same, is connected rotation-fast to the alarm-setting wheel 55. This connection can be materialized by rivets, not shown, or by means of an adhesive. In the assembled state, as is depicted in FIG. 8, the legs 87 of the contact spring 84 are biased, so that the hour wheel is pressed against the shoulder between the pinion 63 and the cannon pinion 62.

FIGS. 8 and 9 show the hour wheel 60 and the contact spring 84 in that relative position to one another, in which position the tongues 92 rest against the beveled front surfaces 83 of the rib 81 of the hour wheel 60, and the arm 91 with part of the wipers 93 and 94 are within the aperture 80 of the hour wheel 60. In this position, the contacts of the wipers 93 and 94 rest on the circular conductor paths 79 and 78, respectively.

Now, if a relative rotation takes place between the contact spring 84 and the hour wheel 60, be it through the turning of the hour wheel 60 clockwise or through turning of the alarm-setting wheel 55 clockwise or counterclockwise, the arm 91 is lifted, according to the direction of rotation, by one of the oblique tongues 92 in co-operation with the associated beveled front surface 83 in the direction toward the alarm-setting wheel 55 out of the aperture 80 of the hour wheel 60. Simultaneously, the wipers 93 and 94 are also lifted off the circular conductor paths 79 and 78 and brought between the hour wheel 60 and the alarm-setting wheel 55. After the tongues 92 in co-operation with the beveled front surfces 83 have completely lifted the arm 91, the inner end region of the arm 91 rests against the circular rib 81 of the hour wheel 60.

When, after an almost full revolution, the arm 91 with the tongues 92 again reaches the slot 82, the arm 91 with the wipers 93 and 94 is again lowered into the aperture 80 of the hour wheel 60, and the contacts of the wipers 93 and 94 once more establish an electrical connection between the circular conductor paths 78 and 79, which causes the alarm-signal device, not shown, to generate an acoustic alarm signal.

In the exemplified embodiment according to FIGS. 8 to 11, the setting of the alarm time may take place through rotation of the alarm-setting wheel clockwise or countercloskwise, without the contact spring or any other component being damaged. Furthermore, the contacts of the wipers 93 and 94 rest upon the conductor paths 79 and 78, respectively, only twice a day for a short interval of time of, for example, about 10 minutes, and during the whole remaining time they do not rest anywhere. The wear and tear and the danger of contamination of the contacts and the contact paths is thereby reduced to a minimum.

The contact bridge 26 or contact spring 84 respectively used in the above-described exemplified embodiments of the alarm clock according to the invention can be easily manufactured and can be readily inserted in the recess 24 provided therefor in the sliding wheel 12 or secured to the alarm-setting wheel 55, respectively, by an automatic machine (robot). The relatively expensive subsequent adjustment of the contact bridge or the contact spring, respectively, can be dispensed with.

I claim:

1. An alarm clock comprising: a movement;

a printed circuit board for receiving electronic components;

an alarm signal device for generating an acoustic alarm signal;

an adjustable electrical contact means for putting the alarm signal device in operation;

means for setting said adjustable electrical contact means in a preselected alarm time position;

switch means for shutting off the alarm signal generation;

said printed circuit board (14 or 75) having an opening through which a pipe (7 or 59) of a movable hour-wheel of the movement extends, characterized in that on the printed circuit board (14 or 75) there are two circular conductor paths (17 and 18 or 78 and 79) disposed concentrically with the hour-wheel pipe (7 or 59);

said adjustable electrical contact means including a portion for bridging and contacting said circular conductor paths;

means for mounting said adjustable electrical contact means so that said bridging and contacting portion is spaced from the circular conducting paths and from said hour-wheel; and means for bridging and contacting the circular conducting paths when said hour-wheel reaches said preselected alarm time position thereby initiating generation of the acoustic alarm signal, said means for bridging and contacting including said adjustable electrical contact means.

2. An alarm clock according to claim 1, wherein, said means for mounting the adjustable contact means includes:

a settable alarm-setting wheel (55) rotatably placed on the hour-wheel pipe (59), the adjustable contact means is connected rotation-tight to the alarm-setting wheel (55) and has two wipers (93 and 94) connected via a crosspiece (91); and said means for bridging and contacting the circular conductor paths includes:

an hour-wheel (60) rigidly connected to the hour-wheel pipe (59), the hour-wheel (60) having at one location an aperture (80) through which the ends of the wipers (93 and 94) pass at a time set by means of the alarm-setting wheel (55) thereby bridging the circular conductor paths (78 and 79) and initiating generation of the acoustic alarm signal.

3. An alarm clock according to claim 2, characterized in that the adjustable contact means (84) has a circular portion (85), from the circular portion (85) at least three legs (87) extend in a radial direction toward the hour-wheel (60), in the circular portion (85) there is an arcuate slot (86) which extends over an angle of about 100 degrees, an arch piece (90) bounding the arcuate slot (86) outwardly, is bent at both ends at two places, so that a region of the arch piece (90) between its ends lies in a different plane than the circular portion (85), an arm (91) extends radially outward from the arch piece (90), having wipers (93 and 94) disposed thereon, the arm (91) having at opposite locations a tongue (92) extending tangentially and at an angle to the alarm-setting wheel (55).

4. An alarm clock according to claim 3, characterized in that the hour-wheel (60) is made of an electrically insulating material and has an axially projecting and substantially circular rib (81) against which part of the arm (91) rests, except at the alarm time and at least half a minute thereafter, a slot (82) extends radially inward from the middle region of an aperture (80), and the circular rib (81) bordering on the slot (82) has two ends with obliquely disposed front surfaces (83) for cooperating with the obliquely placed tongues (92) of the arm (91).

5. An alarm clock according to claim 4, characterized in that the length of the aperture (80) is greater than the dimension between the ends of the two wipers (93 and 94), and the width of the radial slot (82) is greater than the width of the arm (91).

6. An alarm clock according to claim 4 or 5, characterized in that the alarm-setting wheel (55) is made of an electrically insulating material, the adjustable contact means (84) is made of a spring alloy, and the circular portion (85) of the contact means (84) is secured to the alarm-setting wheel (55) by gluing or riveting.

7. An alarm clock comprising:

a movement;

a printed circuit board for receiving electronic components;

an alarm signal device for generating an acoustic alarm signal;

an adjustable contact means for putting the alarm signal device in operation;

switch means for shutting off the alarm signal generation;

said printed circuit board (14 or 75) having an opening through which an hour-wheel pipe (7 or 59) of the movement extends, characterized in that on the printed circuit board (14 or 75) there are two circular conductor paths (17 and 18 or 78 and 79) disposed concentrically with the hour-wheel pipe (7 or 59);

means for mounting the adjustable contact means;

means for bridging the circular conductor paths thereby initiating generation of the acoustic alarm signal; wherein, said means for mounting the adjustable contact means includes:

a settable alarm-setting wheel (55) rotatably placed on the hour-wheel pipe (59), the adjustable contact means is connected rotation-tight to the alarm-setting wheel (55) and has two wipers (78 and 79) connected via a crosspiece (91);

said means for bridging the circular conductor paths includes:

an hour-wheel (60) rigidly connected to the hour-wheel pipe (59), the hour-wheel pipe (60) having at one location an aperture (80) through which the ends of the wipers (93 and 94) pass at a time set by means of the alarm-setting wheel (55) thereby bridging the circular conductor paths (78 and 79) and initiating generation of the acoustic alarm signal; and said adjustable contact means (84) has a circular portion (85), from the circular portion (85) at least three legs (87) extend in a radial direction toward the hour-wheel (60), in the circular portion (85) there is an arcuate slot (86) which extends over an angle of about 100, an arch piece (90) bounding the arcuate slot (86) outwardly, is bent at both ends at two places, so that a region of the arch piece (90) between its ends lies in a different plane than the circular portion (85), an arm (91) extends radially outwardly from the arch piece (90), having wipers (93 and 94) disposed thereon, the arm (91) having at opposite locations a tongue (92) extending tangentially and at an angle to the alarm-setting wheel (55).

8. An alarm clock according to claim 7, characterized in that the hour-wheel (60) is made of an electrically insulating material and has an axially projecting and substantially circular rib (80) against which part of the arm (91) rests, except at the alarm time and at least half a minute thereafter, a slot (82) extends radially inward from the middle region of an aperture (80), and the circular rib (81) bordering on the slot (82) has two ends with obliquely disposed front surfaces (83) for cooperating with the obliquely placed tongues (92) of the arm (91).

9. An alarm clock according to claim 8, characterized in that the length of the aperture (80) is greater than the dimension between the ends of the two wipers (93 and 94), and the width of the radial slot (82) is greater than the width of the arm (91).

10. An alarm clock according to claim 8 or 9, characterized in that the alarm-setting wheel (55) is made of an electrically insulating material, the adjustable contact means (84) is made of a spring alloy, and the circular portion (85) of the contact means (84) is secured to the alarm-setting wheel (55) by gluing or riveting.

* * * * *

UNITED STATES PATENT AND TRADEMARK OFFICE

CERTIFICATE OF CORRECTION

PATENT NO. : 4,922,475

DATED : May 1, 1990

INVENTOR(S) : Matthias Scholer

It is certified that error appears in the above-identified patent and that said Letters Patent is hereby corrected as shown below:

Column 1, Line 43, "nvention" should read --invention--.

Column 2, Line 37, "hourwheel" should read --hour-wheel--.

Column 3, Line 49, "18" (1st occurrence) should read --17--.

Column 4, Line 58, "perture" should read --aperture--.

Column 5, Line 57, "tha" should read --the--.

Column 9, Line 27, "outwardly" should read --outward--.

Column 10, Line 8, "(80)" should read --(81)--.

Signed and Sealed this

Twenty-fourth Day of December, 1991

*Attest:*

HARRY F. MANBECK, JR.

*Attesting Officer*

*Commissioner of Patents and Trademarks*